US006875072B2

(12) United States Patent
Nishida

(10) Patent No.: US 6,875,072 B2
(45) Date of Patent: Apr. 5, 2005

(54) HIGH-PRESSURE DISCHARGE LAMP AND METHOD OF FABRICATING SAME

(75) Inventor: Kazuhisa Nishida, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/706,094

(22) Filed: Nov. 13, 2003

(65) Prior Publication Data

US 2004/0097163 A1 May 20, 2004

Related U.S. Application Data

(62) Division of application No. 10/318,211, filed on Dec. 13, 2002, now Pat. No. 6,693,379.

(30) Foreign Application Priority Data

Dec. 20, 2001 (JP) ..... 2001-388142

(51) Int. Cl.[7] ..... H01J 29/26
(52) U.S. Cl. ..... 445/43; 445/44
(58) Field of Search ..... 445/43, 44

(56) References Cited

U.S. PATENT DOCUMENTS

| | | | |
|---|---|---|---|
| 6,232,719 | B1 | 5/2001 | Kaneko et al. |
| 6,428,379 | B2 | 8/2002 | Kaneko et al. |

FOREIGN PATENT DOCUMENTS

| | | |
|---|---|---|
| JP | 03-163744 | 7/1991 |
| JP | 03-163748 | 7/1991 |
| JP | 10-223175 | 8/1998 |
| JP | 10-255720 | 9/1998 |
| JP | 10-269941 | 10/1998 |
| JP | 11-176385 | 2/1999 |
| JP | 11-111226 | 4/1999 |
| JP | 11-176378 | 7/1999 |
| JP | 2001-143658 | 5/2001 |
| JP | 3204189 | 6/2001 |
| JP | 2001-189149 | 7/2001 |
| JP | 2001-250504 | 9/2001 |
| JP | 2001-256918 | 9/2001 |
| JP | 2001-160374 | 12/2001 |

OTHER PUBLICATIONS

Japanese Office Action dated Mar. 16, 2004 with English translation of pertinent portions.

*Primary Examiner*—Joseph Williams
(74) *Attorney, Agent, or Firm*—Whitham, Curtis & Christofferson, PC

(57) ABSTRACT

The high-pressure discharge lamp of the present invention includes: a discharge chamber that is formed in a silica glass tube, a pair of electrodes that are arranged with ends confronting each other in the discharge chamber; metal foil parts that are superposed and bonded to the other ends of the electrodes, and sealing sections for hermetically sealing the discharge chamber and which are parts for embedding the other ends of the electrodes and the metal foil parts in the glass at the two ends of the silica glass tube. The electrodes and the metal foil parts are embedded in the glass in a state in which metal coils are wrapped around the vicinities of the junctions of the electrodes and metal foil parts. The ends of the metal foil parts on the electrode side are further formed as tapered portions. In addition, the tips of the tapered portions on the electrode side are positioned, with respect to their direction of width, within the width in the radial direction of the electrodes.

2 Claims, 5 Drawing Sheets

HIGH-PRESSURE DISCHARGE LAMP AND METHOD OF FABRICATING SAME

RELATED APPLICATION

This application is a divisional of U.S. Ser. No. 10/318,211 filed on Dec. 13, 2000, now U.S. Pat. No. 6,693,379 and is incorporated herein by reference.

BACKGROUND OF THE INVENTION

1. Field of the Invention

The present invention relates to a high-pressure discharge lamp.

2. Description of the Related Art

Extra-high-pressure mercury lamps are currently being used as the light source of liquid crystal projectors.

Compared to such as a metal halide lamp, a typical mercury lamp has weak light emission in the red region in the optical color rendering (spectrum distribution). Increasing the operating pressure (the internal pressure of the lamp during illumination), however, allows a continuous spectrum to be obtained in the red region even with the mercury lamp, and further, produces a light source that is superior from the viewpoints of both efficiency characteristics and life expectancy characteristics.

A high-pressure discharge lamp includes bulb 1 that is composed of: a spherical portion that forms discharge chamber 1*a* in the center of a glass tube; and slender glass sealing sections 1*b* and 1*b*' for sealing the openings at the two ends of the glass tube, as shown in FIG. 1. In discharge chamber 1*a*, a pair of electrodes 4 and 4' provided with cooling coils 2 and 2' are arranged such that the tips of the electrodes 4 and '4 confront each other. The back ends of these electrodes 4 and 4' are connected to lead rods 7 and 7', respectively, with molybdenum foil parts (Mo foil) 6 and 6', respectively, interposed. The back ends of electrodes 4 and 4', the molybdenum foil parts 6, and 6", and one end of each of lead rods 7 and 7' are hermetically buried within the glass that forms glass sealing section 1*b* and l*b*'. Finally, mercury, halogen gas, and an inert gas are sealed inside discharge chamber 1*a*.

However, since the operating pressure of the extra-high-pressure mercury lamp that is receiving attention as the light source of a liquid crystal projector is 200 atmospheres or more, a major problem is the prevention of damage to the lamp itself. In particular, rupture of the lamp produces a loud noise and scatters harmful substances such as mercury and halogen gas and thus poses a danger to the end user, and various measures for preventing breakage have therefore been proposed. For example, Japanese Patent Laid-Open No. 111226/1999 proposes that metal foil parts (for example molybdenum foil parts) be bonded to the electrodes that are positioned in the discharge space and that these metal foil parts be embedded in the glass that forms the sealing sections at the two ends of the lamp, the electrode side of these metal foil parts being formed in a rounded shape (curved shape).

In this official gazette, the lack of angular portions in the electrode-side ends of the metal foil parts inside the glass sealing sections provides a suppression of both concentrations of stress against these electrode-side ends and the occurrence of cracks in the electrode-side ends of the metal foil parts, whereby sufficient pressure resistance for the operating pressure can be obtained at both ends of the swelled glass portion.

Alternatively, Japanese Patent Laid-Open No. 250504/2001 proposes a construction in which the ends of electrodes and metal foil parts that are welded to these electrodes are sealed inside the sealing sections that seal the openings at the two ends of a glass tube, the welded portions of the electrodes and the metal foil parts being further covered by metal foil parts such that the ends of the electrodes are not exposed, and further, the width of the electrode-side ends of the metal foil parts being less than the width of the opposite-side ends of the electrodes. In particular, the metal foil parts are provided with a triangular shape, and the edge portions of the metal foil parts of this triangular shape are streamlined.

In this official gazette, the lack of any stepped portions between the electrodes and the metal foil parts at the welded portions of the electrodes and metal foil parts and the lack of any angles in the electrode-side ends of the metal foil parts enable a reduction of cracks that occur in the glass in the vicinity of the welded portions of the electrodes and metal foil parts when melting the two ends of the glass tube to form sealing sections, thereby obtaining an improvement in the pressure resistance of the lamp.

Japanese Patent No. 3204189 further proposes a construction in which metal foil parts (for example, molybdenum foil parts) that are bonded to electrodes that are positioned in the discharge space are buried inside the glass that forms the sealing sections at the two ends of the lamp, and further, in which coils are wrapped around the portions of the electrodes that are buried in the sealing sections.

In this official gazette, the interposition of coils between the electrodes and glass enables a reduction of the occurrence of cracks in the glass that contacts the electrode surfaces during the process of forming the sealing sections. In addition, the patent further reports that the ability to form the sealing sections at high temperature enables an improvement of the close contact between the metal foil parts and glass, whereby a lamp having sufficient pressure resistance can be provided.

Nevertheless, the measures for preventing breakage according to Japanese Patent Laid-Open No. 111226/1999 and Japanese Patent Laid-Open No. 250504/2001 focus only on the concentration of stress against the electrode-side ends of the metal foil parts inside the glass that is formed at the sealing sections, and further, the concentration of stress against the ends of the electrodes on the side of the metal foil parts. The measure for preventing damage according to Japanese Patent No. 3204189 focuses on the occurrence of cracks in the glass that contacts the electrode surface during the process of forming the sealing sections as well as on the close contact between the glass and the metal foil parts.

The primary causes for the occurrence of breakage of the lamp itself include a variety of causes in addition to those described in each of the above-described official gazettes, i.e., glass cracks that are caused by the difference in thermal expansion between the electrodes and the glass that is in contact with the electrodes during cooling following formation of the sealing sections, glass cracks that are caused by the concentration of stress against the ends of the electrodes, and glass cracks that are caused by the concentration of stress against the ends of the metal foil parts; and may also include a combination of these causes. As a consequence, the implementation of one or two of the countermeasures described in each of the official gazettes cannot be expected to have an actual effect.

Furthermore, another factor in addition to the factors described in each of the above-described official gazettes is the occurrence of a gap between the glass and the portions of the electrodes that are embedded in the glass. When such a gap is present, the high pressure that is produced inside the lamp upon lighting causes halogen gas to pass through the gap between the electrodes and the glass and bring about corrosion of the junction between the electrodes and the metal foil as well as corrosion of the metal foil, and this corrosion eventually leads to rupture of the lamp.

In the construction in which coils are wrapped around the portions of the electrodes that are embedded in the glass, as well, when an absolutely hermetic seal is not achieved between the electrodes and the coils, gaps occur between the glass and the portions of the electrodes that are embedded in the glass, and halogen gas that infiltrates this gap passes between the electrodes and the coils and brings about the above-described corrosion that leads to rupture of the lamp. Japanese Patent No. 3204189 discloses a construction in which coils are embedded only in the glass and are not exposed in the light emission space but discloses nothing regarding corrosion caused by halogen gas to the junction portion of the electrodes and metal foil as well as the metal foil itself.

In a construction in which coils are wound around the portions of the electrodes that are sealed inside the sealing sections, deformation of the metal foil that occurs when winding the coils is also a factor for shortening the life expectancy of the lamp. In other words, deformation of the metal foil reduces the close contact between the glass and metal foil, causing separation of the glass and metal foil and bringing about gas leakage of the discharge space.

SUMMARY OF THE INVENTION

It is an object of the present invention to provide a high-pressure discharge lamp that, in view of the increased operating pressure of 200 atmospheres or more, greatly reduces the causes of breakage of the lamp. To this purpose, the present invention provides a construction of a high-pressure discharge lamp that, in comparison with the prior art, can more effectively eliminate the concentration of stress and glass cracks in the vicinity of the junctions of the electrodes and metal foil parts and more effectively eliminate the effects of corrosion caused by halogen gas in the above-described vicinity of the junctions, these factors being causes for breakdown of a lamp.

The high-pressure discharge lamp of the present invention includes: a discharge chamber that is formed in a silica glass tube; a pair of electrodes each having one end that confronts the other electrode in the discharge chamber; metal foil parts that are each superposed and bonded to the other ends of the electrodes; and sealing sections for hermetically sealing the discharge chamber, these sealing sections being portions at both ends of the silica glass tube in which the other ends of the electrodes and the metal foil parts are embedded. In this high-pressure discharge lamp, the vicinities of the junctions of the electrodes and metal foil parts are buried in glass after being wrapped with metal coils. Further, the electrode-side ends of the metal foil parts are tapered. In addition, the electrode-side tips of the tapered ends are positioned with respect to their direction of width, within the width in the radial direction of the electrodes. In this case, mercury, halogen gas, and inert gas are sealed in the discharge chamber.

According to this construction, the vicinities of the junctions of the electrodes and metal foil parts with metal coils interposed are buried in glass, thereby enabling a prevention of the occurrence of glass cracks caused by the difference in thermal expansion between the glass and the electrodes during the process of cooling after forming the sealing sections. Further, due to the tapered form of the electrodes-side ends of the metal foil parts as well as to the provision that the electrode-side tips of the tapered ends that are bonded to the ends of the electrodes be positioned, with respect to their direction of width, within the width in the radial direction of the electrodes, the metal coils can be arranged in the vicinities of the junctions of the electrodes and metal foil parts without deforming the metal foil parts, whereby the separation of glass at the metal foil parts as well as the concentration of stress in the vicinities of the junctions of the electrodes and metal foil parts can be mitigated. In addition, forming the electrode-side ends of the metal foil parts in a tapered shape and winding the metal coils as far as the ends of the electrodes can alleviate the concentration of stress at not only the ends of the metal foil parts on the side of the electrodes, but at the ends of the electrodes on the side of the metal foil parts. In other words, the construction of the present invention simultaneously solves the various causes of rupture of a lamp that were noted in the constructions of the prior art and can therefore provide a lamp that is subject to a far lower incidence of breakdown than a lamp of the prior art.

In the above-described high-pressure discharge lamp, the ends of the electrodes on the side of the metal foil parts are preferably covered by metal coils. In other words, covering the metal foil-side ends of the electrodes with metal coils provides a still greater alleviation of the concentration of stress against the metal foil-side ends of the electrodes.

Further, the dimensions of the high-pressure discharge lamp preferably satisfy the relation $Wc \leqq D$ (more preferably, $Wc \leqq 0.8\ D$) where Wc is the width of electrode-side tips of the tapered portions of the metal foil parts and D is the diameter of the electrodes; preferably satisfy the relation $D/8 \leqq d \leqq D/2$ where d is the wire diameter of the metal coil and D is the diameter of the electrodes; preferably satisfy the relation $L1 \geqq 2D$ where L1 is the coil length of the metal coils and D is the diameter of the electrodes; and preferably satisfy the relation $W \leqq L2 \leqq 3W$, where L2 is the cut length of the tapered portions of the metal foil parts and W is the width of the metal foil parts.

These stipulations regarding the forms of the metal foil parts, electrodes, and metal coils enable a solution to the causes of rupture of lamps such as the glass cracks that are caused by the difference in thermal expansion between the electrodes and the glass that contacts the electrodes during the process of cooling after formation of the sealing sections, glass cracks caused by the concentration of stress against the electrode ends, glass cracks caused by the concentration of stress against the ends of the metal foil parts, and the deformation of the metal foil parts that occurs when winding coils around the portions of the electrodes that are to be embedded in glass.

In the above-described high-pressure discharge lamp, mercury is preferably injected to a level of 0.12 $mg/mm^3$ or more; at least one of chlorine, bromine, and iodine is preferably injected as a halogen gas to a halogen gas partial pressure of $1\times10^{-8}$–$1\times10^{-6}$ $\mu mol/mm^3$ in the discharge chamber; and the partial pressure of residual oxygen in the discharge chamber is preferably $2.5\times10^{-3}$ Pa or less. The introduction of gas in these amounts can suppress halogen gas corrosion of the junctions of the electrodes and the metal foil parts as well as corrosion of the metal foil parts despite the presence of a gap between the electrode surfaces on which the metal coils are not wrapped and the glass that surrounds these electrode surfaces of the portions of the electrodes that are embedded in the glass, and thus can effectively prevent rupture of the lamp. This construction can also prevent darkening of the glass tube and loss of luminance over long periods of illumination.

In addition, when fabricating the high-pressure discharge lamp of the present invention, the high-pressure discharge lamp is obtained by successively carrying out: a bulb formation step, an electrode assembly fabrication step, a first electrode incorporation step, a first sealing step, a mercury introduction step, a second electrode incorporation step, an evacuation step, an inert gas introduction step, a halogen gas introduction step, and a second sealing step.

A bulb having a swelled portion for the discharge chamber is first formed using a silica glass tube (Bulb Formation Step). Metal coils are next inserted onto the electrodes; the ends of the electrodes and the tapered portions of the metal foil parts are superposed; following which, either before or after the metal coils are moved and secured to the position at which the superposed portions are to be covered, the electrodes and metal foil parts are connected by welding or crimping; whereby the electrode assembly is fabricated (Electrode Assembly Preparation Step). An electrode assembly is next inserted into the opening of one end of the silica glass tube (First Electrode Incorporation Step). One end of the silica glass tube is then heated, and the other end of the electrode, the metal coil, and the metal foil parts are embedded in the glass on this end to realize a hermetic seal of the discharge chamber (First Sealing Step). Mercury is next introduced into the discharge chamber from the opening at the other end of the silica glass tube (Mercury Introduction Step), following which an electrode assembly is inserted into the opening at the other end of the silica glass tube (Second Electrode Incorporation Step). The air in the discharge chamber is then evacuated from the opening at the other end of the silica glass tube (Evacuation Step), and inert gas is introduced into the discharge chamber from the opening at this other end of the silica glass tube (Inert Gas Introduction Step). The halogen gas is next introduced into the discharge chamber from the opening at this other end of the silica glass tube (Halogen Gas Introduction Step). This end of the silica glass tube is then heated, and the other end of the electrode, the metal coil, and the metal foil parts are embedded in the glass at this end to realize a hermetic seal of the discharge chamber (Second Sealing Step).

This fabrication method can provide a high-pressure discharge lamp that, in comparison with the prior art, can reduce the concentration of stress and the glass cracking that results from this stress in the vicinities of the junctions of the electrodes and metal foil parts, and that can prevent rupture of the lamp.

In the above-described fabrication method, the residual oxygen partial pressure is preferably evacuated to $2.5\times10^{-3}$ Pa or less in the discharge chamber in the evacuation step; an amount of mercury is preferably injected to a level of at least 0.12 mg/mm$^3$ with respect to the spatial capacity of the discharge chamber in the mercury introduction step; and halogen gas is preferably introduced such that the partial pressure of the halogen gas in the discharge chamber is within the range of $1\times10^{-8}$, to $1\times10^{-6}$ $\mu$mol/mm$^3$ in the halogen gas introduction step. This method of fabrication enables the production of a high-pressure discharge lamp that exhibits relatively little darkening of the glass tube and little drop in luminance over a long period of illumination, and moreover, that is free from corrosion by halogen gas of the junctions of the electrodes and metal foil parts as well as the metal foil parts itself.

The above and other objects, features, and advantages of the present invention will become apparent from the following description with reference to the accompanying drawings, which illustrate examples of the present invention.

DETAILED DESCRIPTION OF THE PREFERRED EMBODIMENTS

Figure 1:
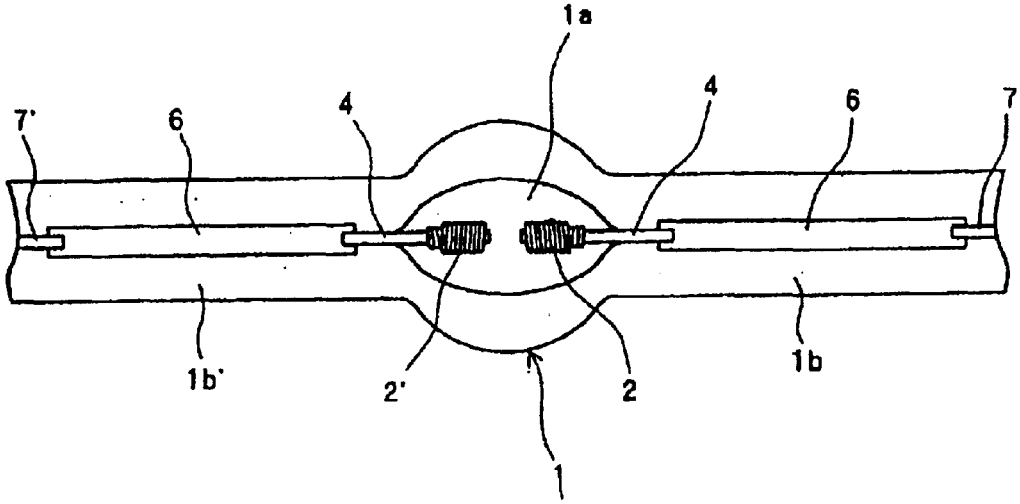
Fig. 1 (Prior Art)
FIG. 1 is a sectional view of the principal elements of a high-pressure discharge lamp of the prior art.
Figure 2:
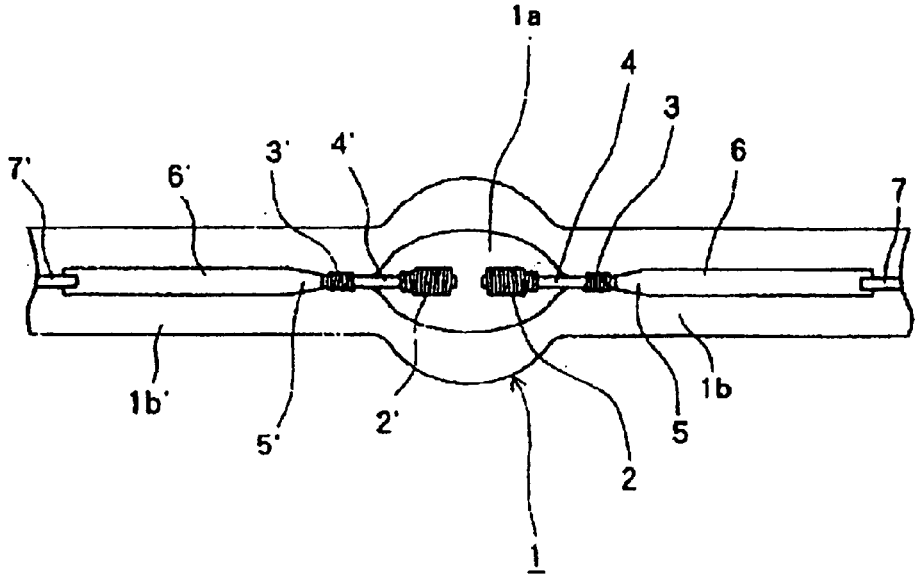
FIG. 2 is a sectional view showing a high-pressure discharge lamp according to one embodiment of the present invention.

Referring now to FIG. 2, a high-pressure discharge lamp of the present embodiment includes bulb 1 that is made from silica glass and that is composed of: a bulb section that forms discharge chamber 1*a* in the center of a glass tube; and long slender sealing sections 1*b* and 1*b*' in which the openings at the two ends of the glass tube are sealed. A pair of rod-shaped electrodes 4 and 4' made of tungsten are positioned in discharge chamber 1*a* of bulb 1 such that their tips confront each other, and cooling coils 2 and 2' are wound around the tips of each of electrodes 4 and 4'. Constituent elements that are identical to elements of the lamp of the prior art in FIG. 1 are identified in FIG. 2 using the same reference numerals.

The back ends of electrodes 4 and 4', one end of each of lead rods 7 and 7', and molybdenum (Mo) foil parts (metal foil parts) 6 and 6' that join electrodes 4 and 4' and lead rods 7 and 7' are embedded in the glass that forms sealing sections 1*b* and 1*b*'. These components are embedded in the glass in a state in which metal coils 3 and 3' are wound on the electrode 4 and 4' side in the vicinities of the junctions in which molybdenum foil parts 6 and 6' are superposed and bonded to the back ends of electrodes 4 and 4'.

The ends of Molybdenum foil parts 6 and 6' on the side of electrodes 4 and 4' have tapered portions 5 and 5'. These tapered portions 5 and 5' are superposed and bonded to the ends of electrodes 4 and 4', and further, the tips of tapered portions 5 and 5' on the side of electrodes 4 and 4' are positioned, with respect to their own direction of width, within the width of electrodes 4 and 4' in the radial direction.

Mercury and inert gas containing a halogen gas component are injected into discharge chamber 1*a*. In the present embodiment, the amount of injection of mercury is within the range of 0.12–0.30 mg/mm$^3$. Regarding the reason for this range of the amount of injected mercury, in an extra high-pressure mercury lamp for use as the light source of a projector, the mercury pressure must be raised to at least a fixed level during operation to obtain, of the three primary colors, as much red as possible. A concentration of at least 0.12 mg/mm$^3$ is necessary to obtain the minimum mercury pressure that is required for practical use. In addition, since the outer envelope is silica glass, the rupture occurs as the mercury pressure is raised, and the maximum practical amount of mercury in the current state of the art is 0.30 mg/mm$^3$. Thus, to obtain prescribed luminance that includes the distribution of the three primary colors that is required of a light source for a projector, the amount of mercury that is required for practical use is at least 0.12 mg/mm$^3$, and preferably equal to or less than 0.30 mg/mm$^3$.

The inert gas is a rare gas such as neon (Ne) or argon (Ar), and as the halogen gas, at least one gas of chlorine (Cl), bromine (Br), and iodine (I) is injected and the halogen gas partial pressure in discharge chamber 1*a* adjusted to between $1\times10^{-8}$–$1\times10^{-6}$ $\mu$mol/mm$^3$. In addition, the interior of the discharge chamber 1*a* is evacuated to produce an attained vacuum level in which the oxygen partial pressure in discharge chamber 1*a* is $2.5\times10^{-3}$ Pa or less. The oxygen partial pressure in this case is the sum of the partial pressures of gas containing oxygen such as $O_2$, CO, $CO_2$, and $H_2O$, and this value can be measured by carrying out an extraction and gas analysis of the gas in the fabricated high-pressure discharge lamp. In addition, the amount of inert gas that is injected is preferably within the range of $6\times10^3$ Pa to $6\times10^4$ Pa.

This high-pressure discharge lamp is lit up by means of a preparatory trigger voltage (5–20 kV) that is supplied from a ballast power supply that is dedicated to lead rods 7 and 7' at both ends of bulb 1. The lamp is then operated by electrical power of 100–300 W, whereby the prescribed lamp luminance is obtained.

Figure 3:
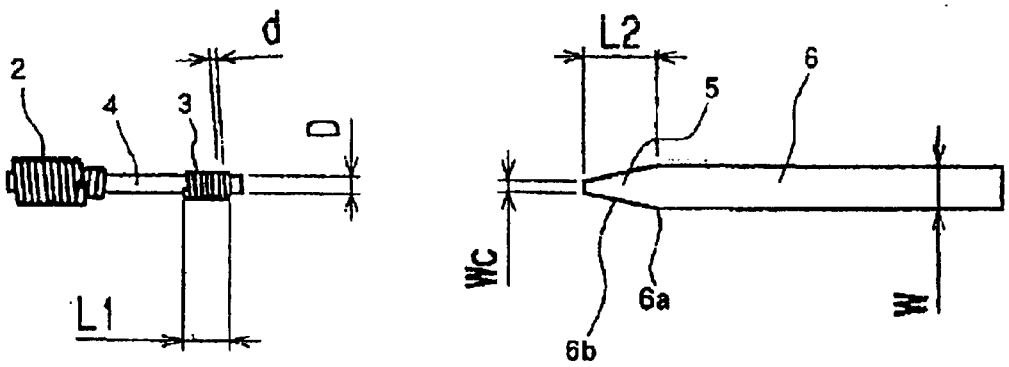
FIG. 3 is a view for explaining the shapes of the electrode, metal coil, and molybdenum foil parts that are shown in FIG. 2.

The various dimensions for each part described hereinbelow for each of electrodes 4 and 4', metal coils 3 and 31, and molybdenum foil parts 6 and 6' are stipulated to desired ranges to eliminate the causes of lamp breakage. An enlarged view of the electrodes and molybdenum foil parts before bonding is shown in FIG. 3 for the purpose of explaining these dimensions. However, since electrode 4, metal coil 3, and molybdenum foil part 6 are identical to electrode 4', metal coil 3', and molybdenum foil part 6', respectively, FIG. 3 shows only electrode 4, metal coil 3, and molybdenum foil part 6 as representative.

(1) Coil Diam ter of the Metal Coils

As shown in FIG. 2, metal coils 3 and 3' that are wound on the side of electrodes 4 and 4' in the vicinities of the junctions of electrodes 4 and 4' and molybdenum foil parts 6 and 6' have the effect of preventing direct sealing (contact) of glass and electrodes 4 and 4' in sealing sections 1*b* and 1*b*', and this configuration can both prevent the glass cracks that occur due to the difference in thermal expansion between glass and electrodes 4 and 4' as well as ease the thermal stress that occurs between electrodes 4 and 4' and glass if direct sealing is realized. In other words, since electrodes 4 and 4' are not bonded to metal coils 3 and 3', respectively, the thermal expansion at the time of lighting the lamp causes metal coils 3 and 3' to slide over electrodes 4 and 4', thus allowing alleviation of stress between the electrodes and the glass.

The occurrence of cracks in the glass, and further, rupture of the lamp were investigated regarding the lamp construction of FIG. 2 for cases in which the wire diameter of metal coils 3 and 3' was varied. The results of this study confirmed that the occurrence of cracks in the glass and rupture of the lamp were reduced when the dimensions were within the range:

$$D/8 \leqq d \leqq D/2$$

where d is the wire diameter of metal coil 3 (3') and D is the diameter of electrode 4 (4'), as shown in FIG. 3.

In other words, the effect of winding metal coil 3 (3') is determined by the relative ratio of wire diameter d and electrode diameter D. Wire diameter d that is too small with respect to electrode diameter D ($d<D/8$) results in thinning of the above-described stress-easing portion (layer) and a marked decrease in effect. Wire diameter d that is too large ($d>D/2$), on the other hand, results in a larger diameter of coil winding of metal coil 3 (3') and an increase in thermal stress during lighting.

Thus, wire diameter d of metal coil 3 (3') is stipulated to be a dimension that satisfies $D/8 \leqq d \leqq D/2$ where the diameter of electrode 4 (4') is D.

(2) The Cut Length of the Tapered Ends of the Molybdenum Foil Parts

The occurrence of glass cracks resulting from the concentration of stress against the ends of molybdenum foil parts 6 and 6' on the electrode 4 and 4' side and moreover rupture of the lamp in the lamp construction shown in FIG. 2 were investigated. The results of this investigation confirmed that the occurrence of glass cracks and rupture of the lamp were reduced when W, which is the width of molybdenum foil parts 6 (6'), and L2, which is the cut length of molybdenum foil parts 6 (6'), fall within the range:

$$W \leqq L2 \leqq 3W$$

as shown in FIG. 3.

In other words, as the cut length L2 of the tapered portion 5 (5') of molybdenum foil part 6 (6') becomes less than the width W of molybdenum foil part 6 (6') (i.e., when $L2<W$), and point of change 6*a* where the width of molybdenum foil part 6 (6') becomes narrow becomes less obtuse, the concentration of stress increases. When the cut length L2 is greater than 3W, on the other hand, cut surface 6*b* of tapered portion 5 (5') of molybdenum foil part 6 (6') becomes long, and glass consequently tends to separate from the cut surface that is not in the knife-edge portion.

Cut length L2 of tapered portion 5 (5') of molybdenum foil part 6 (6') is thus stipulated to be a dimension that satisfies tie relation $W \leqq L2 \leqq 3W$ with respect to width W of molybdenum foil part 6 (6').

(3) The Width of the Tip of Tapered Portions of Molybdenum Foil Parts (Electrode-Side Ends)

If the width of the ends of molybdenum foil parts 6 and 6' on the side of electrodes 4 and 4' (the width of the tips of tapered portions 5 and 5') is greater than the diameter of electrodes 4 and 4' in the lamp construction that is shown in FIG. 2, molybdenum foil parts 6 and 6' may undergo deformation by metal coils 3 and 3' that are wound in the vicinities of the junctions of electrodes 4 and 4' and molybdenum foil parts 6 and 6'. Deformation of molybdenum foil parts 6 and 6' is further aggravated when sealing silica glass to the circumference of molybdenum foil parts 6 and 6', whereby adhesion between the silica glass and molybdenum foil parts 6 and 6' decreases, leading to separation of the silica glass from molybdenum foil parts 6 and 6'. This state eventually leads to leakage of the gas inside discharge chamber 1*a*. Alternatively, glass cracks may occur in the vicinity of the junctions of electrodes 4 and 4' and molybdenum foil parts 6 and 6'.

As a countermeasure, the width of the ends of molybdenum foil parts 6 and 6' on the side of electrodes 4 and 4' (the width of the tips of tapered portions 5 and 5') may be made smaller than the diameter of electrodes 4 and 4' to allow an arrangement of metal coils 3 and 3' that covers the overlap of joined electrodes 4 and 4' and molybdenum foil parts 6 and 6'. As a result, the junctions of electrodes 4 and 4' and molybdenum foil parts 6 and 6' can be obtained such that molybdenum foil parts 6 and 6' are free of deformation. Such an arrangement prevents the occurrence of glass cracks in the vicinity of the junctions of electrodes 4 and 4' and molybdenum foil parts 6 and 6', and prevents the separation of glass at molybdenum foil parts 6 and 6'.

The relation of Wc and D, molybdenum foil deformation, glass separation, and further, and rupture of the lamp was investigated regarding the lamp construction of FIG. 2, in which, as shown in FIG. 3, Wc is the width of the tip of tapered portion 5 (5') of molybdenum foil part 6 (6') and D is the diameter of electrode 4 (4'). The results of this investigation confirm the problem that a width Wc that exceeds the diameter D of electrode 4 (4') results in a higher incidence of molybdenum foil deformation, glass separation, and lamp rupture, as shown in Table 1. However, a width Wc that is 0.8 D or less produces superior results with a lower incidence of deformation and no incidence of glass separation or lamp rupture. In addition, a width Wc that falls in the range 0.8 D–1.0 D produces results between the two cases described above, but these results are within the permissible range for practical purposes.

The width Wc of the end of molybdenum foil part 6 (6') on the side of electrode 4 (4') (the tip of tapered portion 5

(5')) with respect to diameter D of electrode 4 (4') is thus stipulated to be a dimension that satisfies the relation:

$$Wc \leqq D$$

More preferably, this width is stipulated to be:

$$Wc \leqq 0.8\ D$$

Table 1
Relation Between Wc and D, Deformation of the Metal Foil Parts, Separation of Glass, and Rupture of the Lamp

| Relation between Wc and D | Deformation of metal foil parts | Glass separation - Lamp rupture |
|---|---|---|
| $Wc \leqq 0.5 \times D$ | None | None |
| $0.5 \times D \leqq Wc \leqq 0.8 \times D$ | Slight | None |
| $0.8 \times D \leqq Wc \leqq D$ | Moderate | Infrequent |
| $Wc > D$ | Great | Frequent |

(4) The Coil Length of the Metal Coils

The coil length of metal coils 3 and 3' in the lamp construction of FIG. 2 must vary depending on the diameter of electrodes 4 and 4'.

The occurrence of glass cracks as well as rupture of the lamp was investigated for cases in which the coil length of metal coils 3 and 3' was changed. The results of this investigation confirmed that the incidence of glass cracks and lamp rupture was lower when the dimensions were within the range:

$$2D \leqq L1$$

where D is the diameter of electrode 4 (4') and L1 is the coil length of metal coil 3 (3'), as shown in FIG. 3.

A coil length L1 that is less than 2D weakens the effect of alleviation of stress described in the above-described item (1).

The coil length L1 of metal coil 3 (3') with respect to diameter D of electrode 4 (4') is thus stipulated to be a dimension that satisfies the relation:

$$L1 \geqq 2D$$

Figure 4:
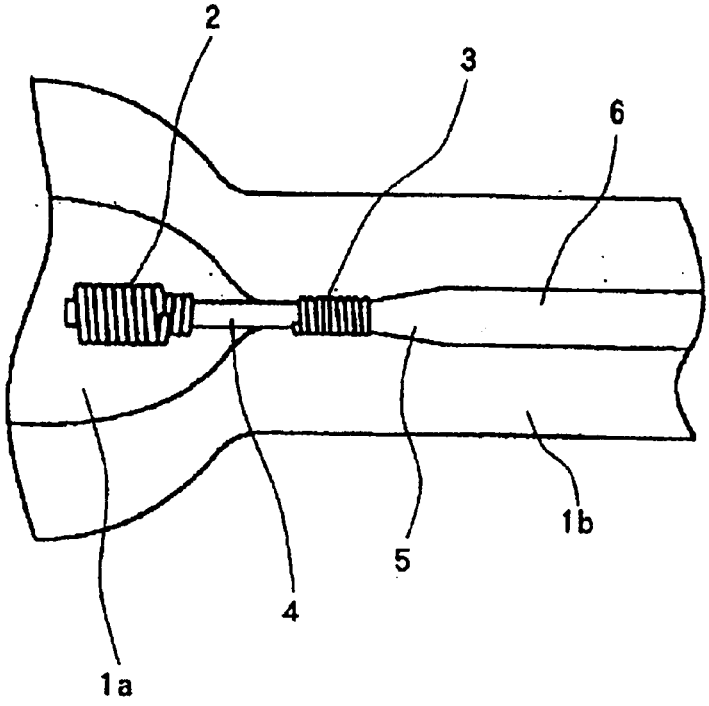
FIG. 4 is a sectional view of the principal elements showing a more preferable winding position of the metal coil that is positioned in the vicinity of the junction of an electrode and molybdenum foil part in the high-pressure discharge lamp that is shown in FIG. 2.

The state for winding metal coil 3 (3') in the vicinity of the junction of electrode 4 (4') and molybdenum foil part 6 (6') shown in FIG. 2 is next described. FIG. 4 is a sectional view of the principal elements showing a preferable position of winding metal coil 3 (3'), and FIG. 5 is a comparison view for comparing the position of winding metal coil 3 (3') shown in FIG. 4.

Metal coil 3 (3') in the vicinity of the junction of electrode 4 (4') and molybdenum foil part 6 (6') is preferably wound to cover the end of electrode 4 (4') on the side of molybdenum foil part 6 (6').

Figure 5:
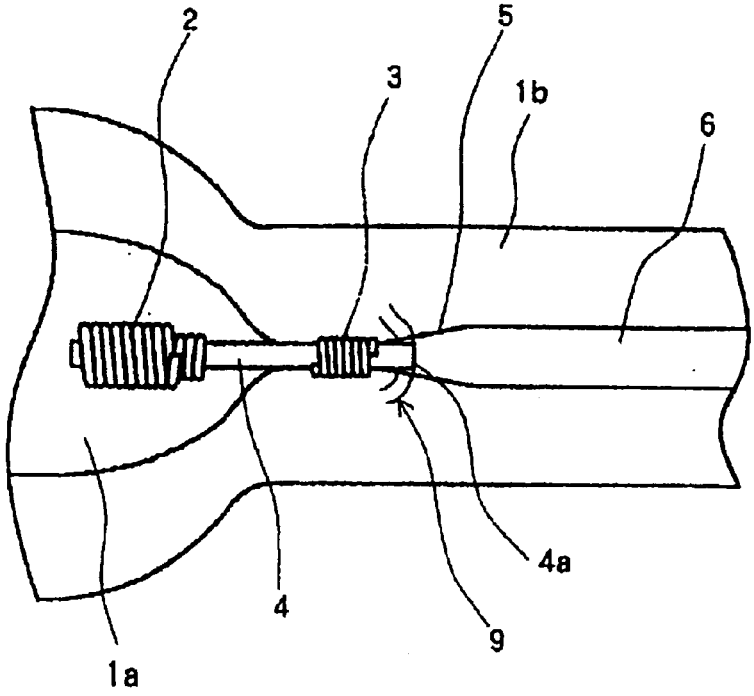
FIG. 5 is a sectional view of the principal elements showing problems that occur when the metal coil is not wound as far as the molybdenum foil-side end of the electrode, as in the high-pressure discharge lamp that is shown in FIG. 2.

In other words, in a construction in which metal coil 3 (3') is not wound as far as the end of electrode 4 (4') on the side of molybdenum foil part 6 (6') as shown in FIG. 5, glass crack 9 occurs due to the concentration of stress against electrode end 4*a*. In contrast, winding metal coil 3 (3') at least as far as the end of electrode 4 (4') on the side of molybdenum foil part 6 (6') as shown in FIG. 4 enabled the complete elimination of the glass crack that can be seen in the construction shown in FIG. 5 and prevent rupture of the lamp.

The forms of electrodes 4 and 4', metal coils 3 and 3', and molybdenum foil parts 6 and 6' that have described using FIGS. 3 and 4 can of course be independently applied to the lamp construction of FIG. 2 or can be applied in appropriate combinations to the high-pressure discharge lamp of the present invention.

Figure 6:
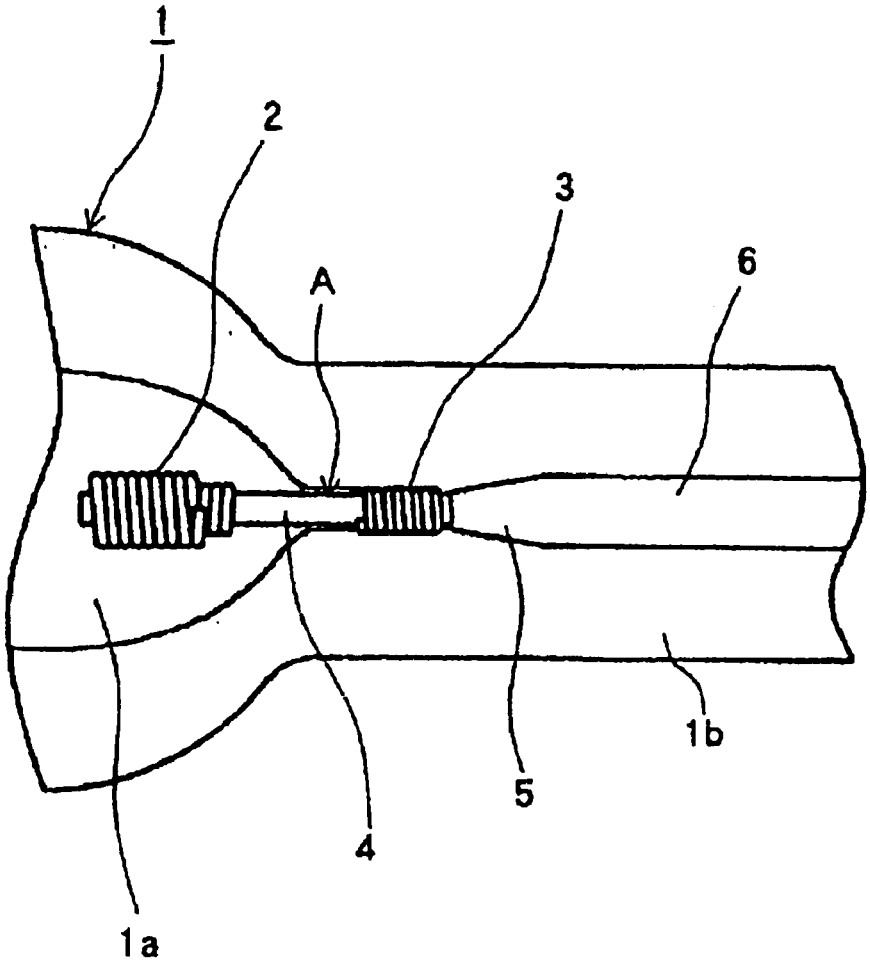
FIG. 6 is a view for explaining the state of airtight contact between the portion of the electrode that is embedded in glass that is shown in FIG. 2 and the surrounding glass.

Further, as shown in FIG. 6, the high-pressure discharge lamp of the present embodiment may include, in the portion of electrode 4 (4') that is embedded in glass, a gap in which airtight contact is not established between electrode surface A on which metal coil 3 (3') is not wound and the glass that surrounds electrode surface A. The reason for this configuration is as follows.

Halogen gas that is injected into discharge chamber 1*a* generates halogen ions in the high-temperature conditions during lighting, these ions combine with tungsten (the electrode material) that has been deposited on the walls of the glass tube, evaporate, and then condense on the relatively low-temperature electrode base. The repetition of this "halogen cycle" can prevent the blackening of the walls of the glass tube. In the prior art, the amount of injected halogen gas was adjusted such that the halogen gas partial pressure in discharge chamber 1*a* ranged from $1\times10^{-6}$ to $1\times10^{-2}$ $\mu$mol/mm$^3$ for this reason. However, as disclosed in Japanese Patent No. 3219084, if the oxygen partial pressure in discharge chamber 1*a* is regulated to less than $2.5\times10^{-3}$ Pa, blackening of the glass tube and a consequent loss in luminance after extended lighting can be prevented even if the amount of injected halogen gas is reduced such that the partial pressure of halogen gas is within the range from $1\times10^{-8}$ to $1\times10^{-7}$ $\mu$mol/mm$^3$. Further, since the amount of injected halogen gas can be decreased even more than the prior art, corrosion of the electrodes and the molybdenum foil that results from the introduction of excessive halogen gas can be prevented.

In the present embodiment, the oxygen partial pressure in discharge chamber 1*a* is regulated to $2.5\times10^{-3}$ Pa or less, and moreover, halogen gas is injected such that the halogen gas partial pressure inside discharge chamber 1*a* ranges from $1\times10^{-8}$ to $1\times10^{-6}$ $\mu$mol/mm$^3$. Here, the upper limit of the amount of halogen content described in Japanese Patent No. 3219084 has been broadened to $1\times10^{-6}$ $\mu$mol/mm$^3$ in consideration of the variation in fabrication (product) in order to enable a further prevention of blackening.

This amount of introduced halogen gas is much smaller than the range of $1\times10^{-6}$ to $1\times10^{-2}$ $\mu$mol/mm$^3$, i.e., the amount of halogen gas that is injected in the prior art, and thus, despite the gap between electrode surface A on which metal coil 3 is not wound and the surrounding glass as shown in FIG. 6, corrosion of the junction between the electrodes and the metal foil parts as well as corrosion of the metal foil parts can be suppressed, and consequently, rupture of the lamp can be prevented. In addition, blackening of the glass tube and the consequent loss in luminance do not occur over extended use.

However, the above-described gap is preferably not so large a gap as to completely expose metal coil 3 (3') to discharge chamber 1*a*. If metal coil 3 (3') is completely exposed to discharge chamber 1*a*, discharge will also occur between metal coil 3 and the confronting metal coil (3') that is opposite metal coil 3 immediately after lighting up, raising the danger of blackening or rupture of the glass tube, and a limitation of the size of the gap is therefore preferable in the interest of preventing this type of abnormal discharge.

Figure 7:
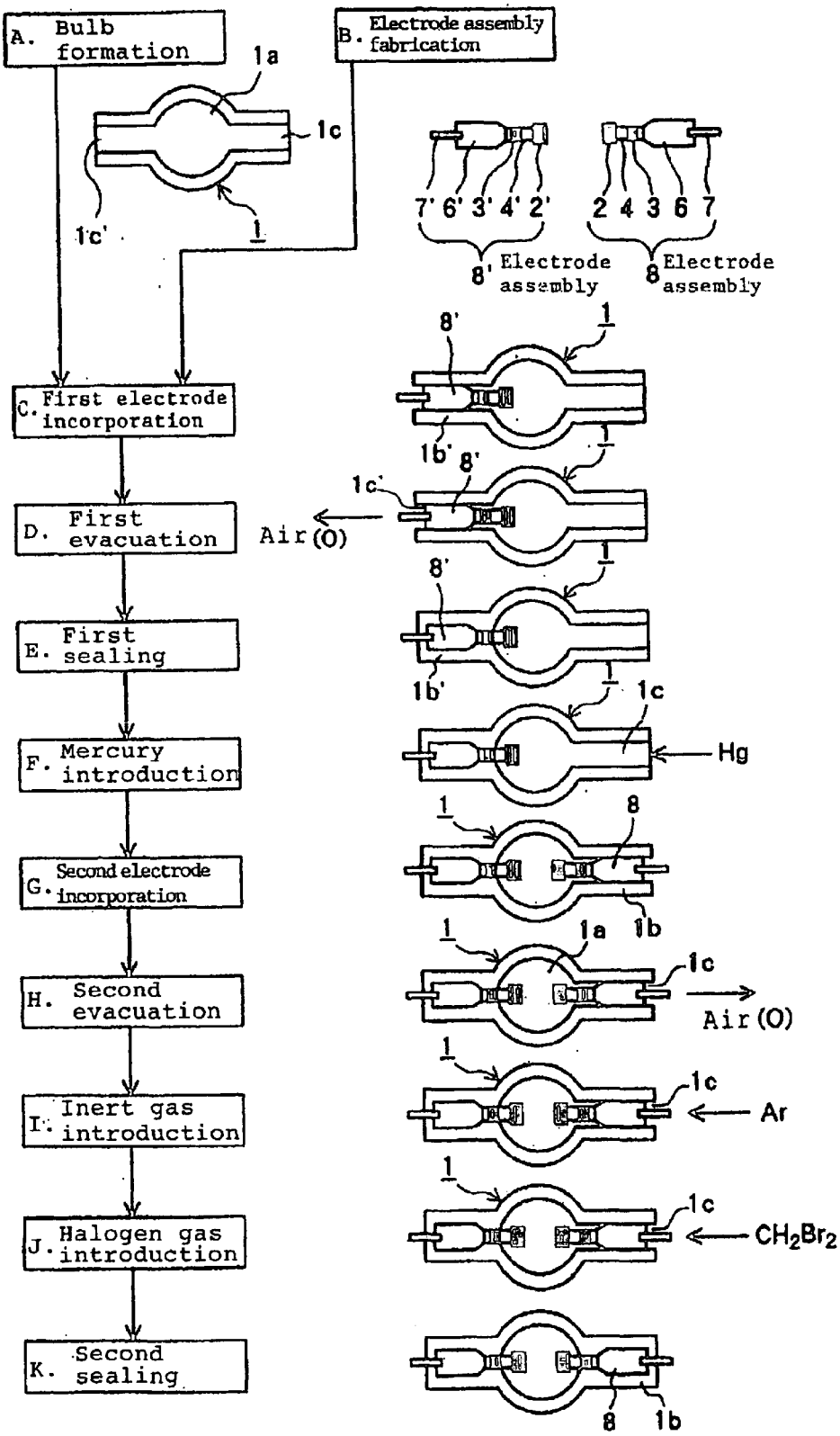
FIG. 7 is a process chart for explaining an example of the fabrication method of the high-pressure discharge lamp of the present invention.

An example of a method of fabricating a high-pressure discharge lamp of the present invention is next described. FIG. 7 shows procedures A–I using a schematic construction of the high-pressure discharge lamp of the present embodiment.

A. Bulb Formation Step: A silica glass tube is used to form bulb 1 having a swelled portion in its center for discharge chamber 1*a*.

B. Electrode Assembly Fabrication Step: Electrode assemblies 8 and 8' are fabricated by inserting metal coils 3 and 3' onto rod-shaped tungsten electrodes 4 and 4'; superposing the ends of electrodes 4 and 4' and tapered portions 5 and 5' of molybdenum foil parts 6 and 6', shifting metal coils 3 and 3' to positions that cover the superposed portions, and then securing; and finally, connecting electrodes 4 and 4' and molybdenum foil parts 6 and 6' by crimping or welding. The shifting and securing of metal coils 3 and 3' may also be performed after connecting electrodes 4 and 4' and molybdenum foil parts 6 and 6'.

C. First Electrode Incorporation Step: Electrode assembly 8' is inserted into opening 1*c*' of one end of bulb 1 and arranged at a prescribed position.

D. First Evacuation Step: The opening 1*c*' side of bulb 1, in which electrode assembly 8' has been arranged, is mounted in an evacuation stand (not shown in the figure), gases within the bulb are evacuated, inert gas is introduced into the bulb, following which the opening 1*c*' end is chipped by means of a gas burner (not shown in the figure). Although this evacuation step is not absolutely necessary in the fabrication of the high-pressure discharge lamp of the present invention, the step can temporarily reduce the amount of residual oxygen in discharge chamber 1*a* and therefore can shorten the time required for subsequent Second Evacuation Step H.

E. First Sealing Step: Sealing section 1*b*' of bulb 1 is heated to approximately 1700° C. by a local heating jig such as a gas burner (not shown in the figure), whereby the end of electrode 4' that is opposite cooling coil 2', one end of lead rod 7', and molybdenum foil part 6' that links electrode 4' and lead rod 7' are embedded in the silica glass that forms sealing section 1*b*'. At this time, of the portions of electrode 4' that are embedded in the glass, the electrode surface on which metal coil 3' is not wound and the glass surrounding this electrode surface need not be in close contact.

F. Mercury Introduction Step: A specialized jig (not shown in the figure) is used to precisely introduce mercury (Hg) from the other opening 1*c* of bulb 1 to 0.200 mg/mm$^3$.

G. Second Electrode Assembly Incorporation Step: Electrode assembly 8 is inserted from opening 1*c* of bulb 1 and, using an appropriate jig (not shown in the figure), arranged such that the distance between electrode 4 and electrode 4' is a fixed interval.

H. Second Evacuation Step: Bulb 1 is mounted on an evacuation stand (not shows in the figure) from opening 1*c* and evacuated until the oxygen (O) partial pressure inside discharge chamber 1*a* is $2.0\times10^{-3}$ Pa.

I. Inert Gas Introduction Step: An amount of argon gas is introduced from opening 1*c* of bulb 1 to 50 kPa.

J. Halogen Gas Introduction Step: Methylene bromide ($CH_2Br_2$) is introduced from opening 1*c* of bulb 1 to attain $5\times10^{-7}$ $\mu$mol/mm$^3$. The end of bulb 1 on the side of opening 1*c* is then chipped by a gas burner (not shown in the figure).

K. Second Sealing Step: Sealing section 1*b* of bulb 1 is next heated to approximately 1700° C. by a local heating jig such as a gas burner (not shown in the figure), and the opposite end of electrode 4 from cooling coil 2, one end of lead rod 7, and molybdenum foil part 6 that links electrode 4 and lead rod 7 are embedded in the silica glass that forms sealing section 1*b*. At this time, of the portions of electrode 4 that are embedded in the glass, the electrode surface on which metal coil 3 is not wound and the glass surrounding this electrode surface need not be in close contact. The above-described processes complete the high-pressure discharge lamp of the present invention.

In the above-described fabrication method, the order of halogen gas introduction step J and inert gas introduction step I can be switched without problem, and moreover, the halogen gas and inert gas may be mixed beforehand or simultaneously introduced into discharge chamber 1*a* to omit one step.

As described in the foregoing explanation, embedding the vicinities of the junctions of the electrodes and metal foil parts in glass with metal coils interposed in the high-pressure discharge lamp of the present embodiment can prevent the occurrence of glass cracks that are caused by the difference in thermal expansion between the glass and electrodes during the process of cooling after forming the sealing section. Furthermore, by forming the ends of the metal foil parts on the electrode side as tapered portions and prescribing that the tips, with respect to the direction of their width, of the tapered portions on the electrode side that are joined with the ends of the electrodes be within the width in the radial direction of the electrodes, the metal coils in the vicinity of the junctions of the electrodes and metal foil parts can be positioned so as not to cause deformation of the metal foil parts, thereby mitigating the separation of glass at the metal foil parts as well as easing the concentration of stress around the junctions of the electrodes and metal foil parts. In addition, forming the ends of the metal foil parts on the electrode side as tapered portions and wrapping the metal coils as far as the ends of the electrodes enables a mitigation of the concentration of stress not only at the ends of the metal foil parts on the electrode side but also at the ends of the electrodes on the metal foil parts side. In other words, this construction can simultaneously provide a solution for the various causes of lamp rupture that occur in constructions of the prior art and therefore can provide a lamp that is subject to far less breakage than a lamp of the prior art.

Further, the stipulations that the partial pressure of residual oxygen in the discharge chamber of the lamp be $2.5\times10^{-3}$ Pa or less, that the amount of injected mercury be within the range 0.12–0.30 mg/mm$^3$ with respect to the spatial capacity of the discharge chamber, and that the partial pressure of halogen gas in the discharge chamber be within the range of $1\times10^{-8}$ to $1\times10^{-6}$ $\mu$mol/mm$^3$ allow the provision of a high-pressure discharge lamp that is subject to little blackening of the glass tube and attendant loss of luminance over long periods of use, and further, that is free of corrosion caused by halogen gas to the junctions of the electrodes and metal foil parts as well as to the metal foil parts themselves.

This dramatic decrease in the amount of halogen gas that is introduced as compared with the prior art enables a suppression of the corrosion caused by halogen gas to the junctions of the electrodes and the metal foil parts as well as to the metal foil parts, and as a result, the problem of lamp rupture will not occur even if a gap should occur between the portions of the electrodes that are embedded in glass and the glass that surrounds these portions. In addition, the opening of such a gap can further prevent glass cracks that occur due to the difference in the thermal expansion of the glass and the electrodes.

While preferred embodiments of the present invention have been described using specific terms, such description is for illustrative purposes only, and it is to be understood that changes and variations may be made without departing from the spirit or scope of the following claims.

What is claimed is:

1. A method of fabricating a high-pressure discharge lamp, said high-pressure discharge lamp comprising a discharge chamber that is formed in a silica glass tube; a pair of electrodes each having one end that confronts one end of the other electrode in said discharge chamber; metal foil parts that each overlie and connect to the other ends of said electrodes; metal coils that are wrapped in the vicinities of the junctions of said electrodes and said metal foil parts; sealing sections for forming a hermetic seal of said discharge chamber, these sealing sections being parts for embedding said other ends of said electrodes, said metal coils, and said metal foil parts in glass at the two ends of said silica glass tube; wherein the ends of said metal foil parts on the electrode side are formed as tapered portions; the tips of said tapered portions on the electrode side are, with respect to the direction of width of the tapered portions, within the width in the radial direction of said electrodes; and mercury, halogen gas, and an inert gas are injected in said discharge chamber;

said method comprising:

a bulb formation step for using a silica glass tube to form a bulb having a swelled portion for said discharge chamber;

an electrode assembly fabrication step for fabricating electrode assemblies by: inserting a metal coil on each of said electrodes, superposing the end of said electrode and the tapered portion of said metal foil part, and then, either before or after shifting and securing said metal coil to a position that covers the superposed portion, connecting said electrode and said metal foil part by crimping or welding;

a first electrode incorporation step for inserting one of said electrode assemblies into the opening of one end of said silica glass tube;

a first sealing step for heating one end of said silica glass tube to embed the other end of said electrode, said metal coil, and said metal foil part in the glass of this end and thus establish a hermetic seal of said discharge chamber;

a mercury introduction step for introducing said mercury into said discharge chamber from the opening at the other end of said silica glass tube;

a second electrode assembly incorporation step for inserting the another of said electrode assemblies into the opening at the other end of said silica glass tube;

an evacuation step for evacuating air inside said discharge chamber from the opening of the other end of said silica glass tube;

an inert gas introduction step for introducing said inert gas into said discharge chamber from the opening of the other end of said silica glass tube;

a halogen gas introduction step for introducing said halogen gas into said discharge chamber from the opening at the other end of said silica glass tube; and a second sealing step for heating the other end of said silica glass tube to embed the other end of said electrode, said metal coil, and said metal foil part in the glass of this other end and thus hermetically seal said discharge chamber.

2. A method of fabricating a high-pressure discharge lamp according to claim 1, wherein:

in said evacuation step, air is evacuated such that the partial pressure of residual oxygen in said discharge chamber is less than or equal to $2.5\times10^{-3}$ Pa; in said mercury introduction step, mercury is introduced such that the amount of mercury that is injected is at least 0.12 mg/mm$^3$ with respect to the spatial volume in said discharge chamber; and in said halogen gas introduction step, halogen gas is introduced such that the partial pressure of said halogen gas in said discharge chamber is within the range from $1\times10^{-8}$ to 1×10−6 $\mu$mol/mm$^3$.

* * * * *